US005109991A

United States Patent [19]

McPherson et al.

[11] Patent Number: 5,109,991

[45] Date of Patent: May 5, 1992

[54] WALLCOVERING SAMPLE STORAGE CONTAINER

[75] Inventors: Cheryl McPherson, Hackensack, N.J.; Gary Stanko, Barrington, Ill.; Richard Urso, Sparta, N.J.

[73] Assignee: J. Josephson, Inc., South Hackensack, N.J.

[21] Appl. No.: 533,988

[22] Filed: Jun. 6, 1990

[51] Int. Cl.[5] ..... A47F 7/00

[52] U.S. Cl. ..... 211/45; 211/135; 108/92

[58] Field of Search ..... 211/135, 128, 45, 59.2; 108/92

[56] References Cited

U.S. PATENT DOCUMENTS

| | | | |
|---|---|---|---|
| 2,888,145 | 5/1959 | Knott et al. | 211/59.2 |
| 3,290,107 | 12/1966 | Kolster | 211/135 X |
| 4,105,126 | 8/1978 | Deffner et al. | 211/59.2 |
| 4,474,297 | 10/1984 | Zucker | 211/59.2 |
| 4,801,023 | 1/1989 | Ecclestone | 211/55 |
| 4,936,468 | 6/1990 | McNabb | 211/45 X |

*Primary Examiner*—Robert W. Gibson, Jr.

*Attorney, Agent, or Firm*—Sprung Horn Kramer & Woods

[57] ABSTRACT

A multi-shelf storage container for books of wallcovering samples comprising a top, bottom, rear, and a pair of side walls spaced from one another, the front of said container between said side walls being open, the side walls being canted rearwardly from bottom to top, and a plurality of essentially horizontal shelves extending between said side walls and from said open front toward said rear. The top, bottom and each shelf is comprised of two halves, each vertical set of shelf halves being connected with one of the side walls, the container including means for joining to one another the halves of at least one of the top, bottom or rear. The halves of each shelf are laterally spaced from one another to define a path therebetween along which the fastener of a wallcovering sample book can ride.

10 Claims, 4 Drawing Sheets

WALLCOVERING SAMPLE STORAGE CONTAINER

The present invention relates to a multi-shelf storage container, especially suited for readily removably storing the individual elements of a book-like series of elements.

It relates particularly to a container for storing wall covering samples arranged in books, in a manner which permits easy removal of each book.

At present, wall covering samples are joined into large books and the books are generally randomly laid out, making it difficult to review a large number of samples.

Small books have sometimes been provided but then the samples are so small one cannot get an impression of the design.

It is an object of the present invention to provide wallcovering samples of a reasonable size bound into books and then provided with a storage container which permits the ready removal and replacement of individual books.

These and other objects are realized in accordance with the present invention pursuant to which there is provided a multi-shelf storage container comprising a top, bottom, rear, and a pair of side walls spaced from one another, the front of said container between said side walls being open, the side walls being canted rearwardly from bottom to top, and a plurality of essentially horizontal shelves extending between said side walls and from said open front toward said rear.

Advantageously, the top, bottom and each shelf is comprised of two halves, each vertical set of shelf halves being connected with one of the side walls, the container including means for joining to one another the halves of at least one of the top, bottom or rear, preferably joining the halves of each of them.

Suitably, each vertical set of shelf halves is integrally molded with its associated side and half top and bottom, the halves of each shelf being laterally spaced from one another to define a path or track therebetween which can accommodate a pin joining the pages of sample making up each book.

The rear wall of each shelf can be vertical, the shelves being stepped at their rears. If desired, for greater vertical stability the side walls can extend rearwardly to support the top-most, rear-most shelf and a rear wall (possibly incomplete) can be provided rearward of the backs of the shelves.

The shelves are advantageously offset rearwardly from bottom to top to form a stair-like series, the offset or angle of cant ranging from about 60 to 80 degrees. In accordance with a preferred embodiment, there is provided an element which can be removably connected with the container to form a space alongside the container in which literature can be stored.

The invention will be further described with reference to the accompanying drawings, wherein FIG. 1 is a perspective view of a container in accordance with the present invention;

Figure 1:
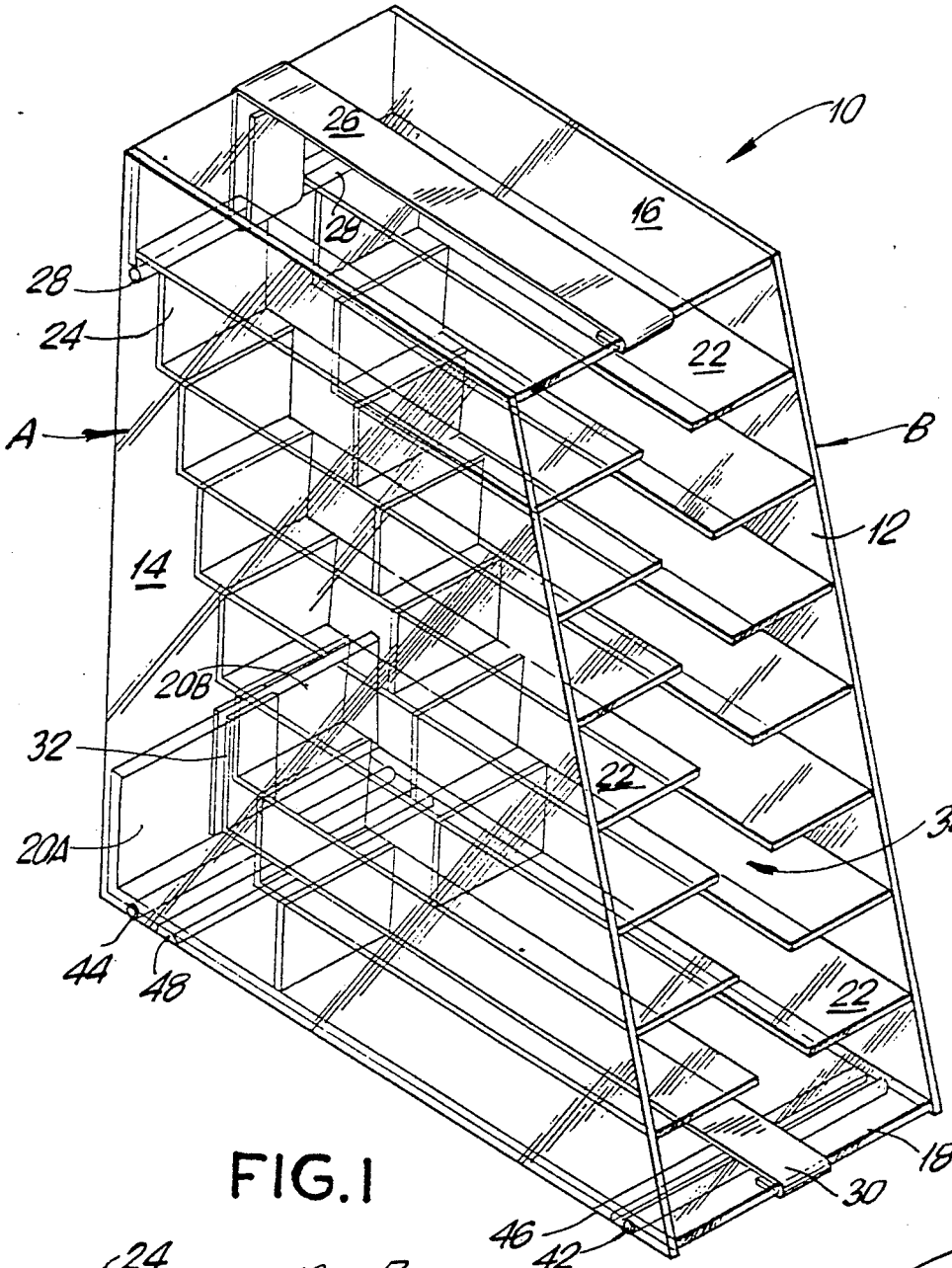
Figure 2:
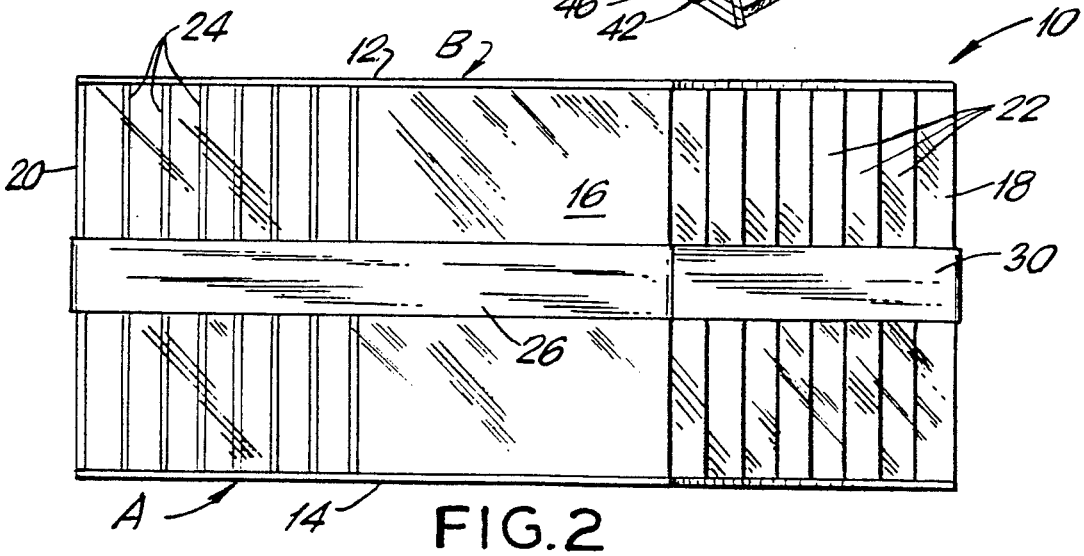
FIG. 2 is a top view.

Referring now more particularly to the drawing, in FIG. 1, there is shown a container 10 comprising a pair of side walls 12, 14, a top 16, and a bottom 18. The rear 20 is seen in FIG. 2.

Actually, the container is made up of two halves, A and B, joined together by clip-like connectors described more fully hereinbelow.

The fronts of side walls 12, 14 taper rearwardly upwardly and between them there extend a plurality of shelves 22, in this embodiment all of the same length. Each shelf has a rear wall 24 which is shown vertical but could be a continuous incline parallel to the taper of the side walls 12, 14.

The bottom of the lower-most shelf 22 extends rearwardly as do the side walls 12, 14 to underlie the top-most shelf and provide support therefor and to prevent rearward tipping.

Figure 3:
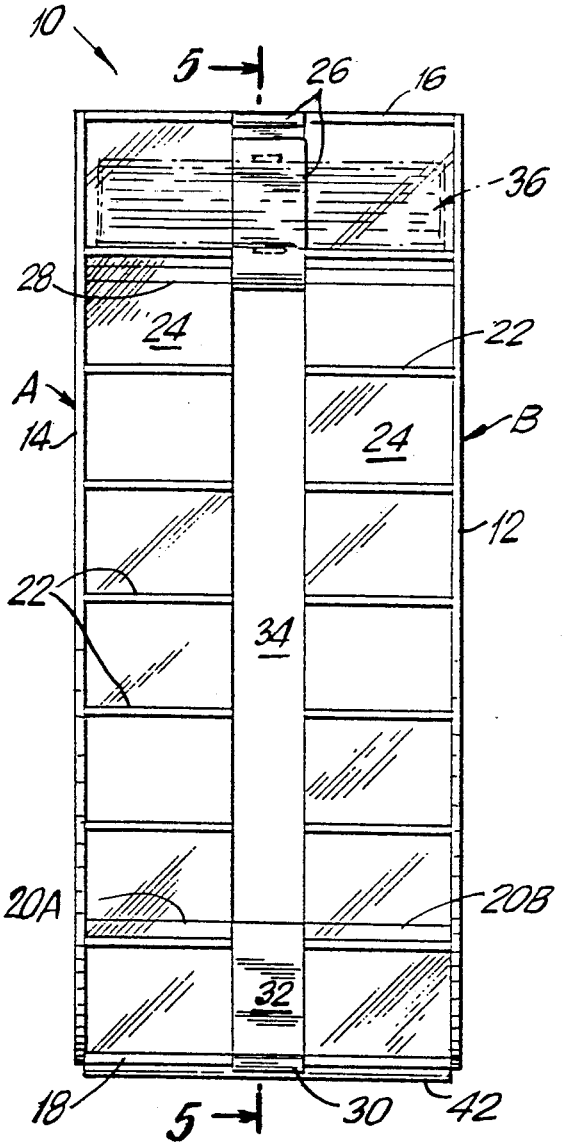
FIG. 3 is a front view.
Figure 4:
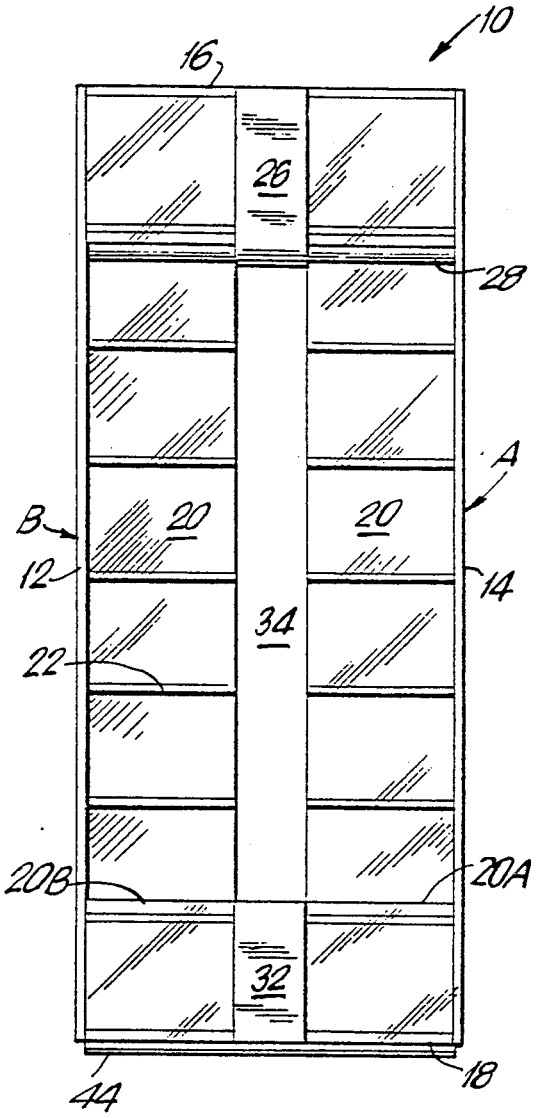
FIG. 4 is a rear view.

As shown in FIGS. 3 and 4, each half A and B of the container 10 has been molded integrally with its shelf halves and the container halves are joined to one another.

Specifically, a somewhat springy metal band 26 seats in grooves provided in the facing halves of the top 16. A tubular element 28 may extend across the width of the container to form an anchor for the bend in band 26, the band encircling the tops of the front halves so as to hold them together.

A springy metal band 30, generally similar to 26, is provided at the bottom except that it is connected to one half 20A of the rear wall while a separate metal element 32 is connected to the other half of the rear wall, 20B. Elements 30 and 32 connect the lower portions of A and B.

Thus, each shelf 22 is made up of two spaced halves defining between them a track 34.

Figure 5:
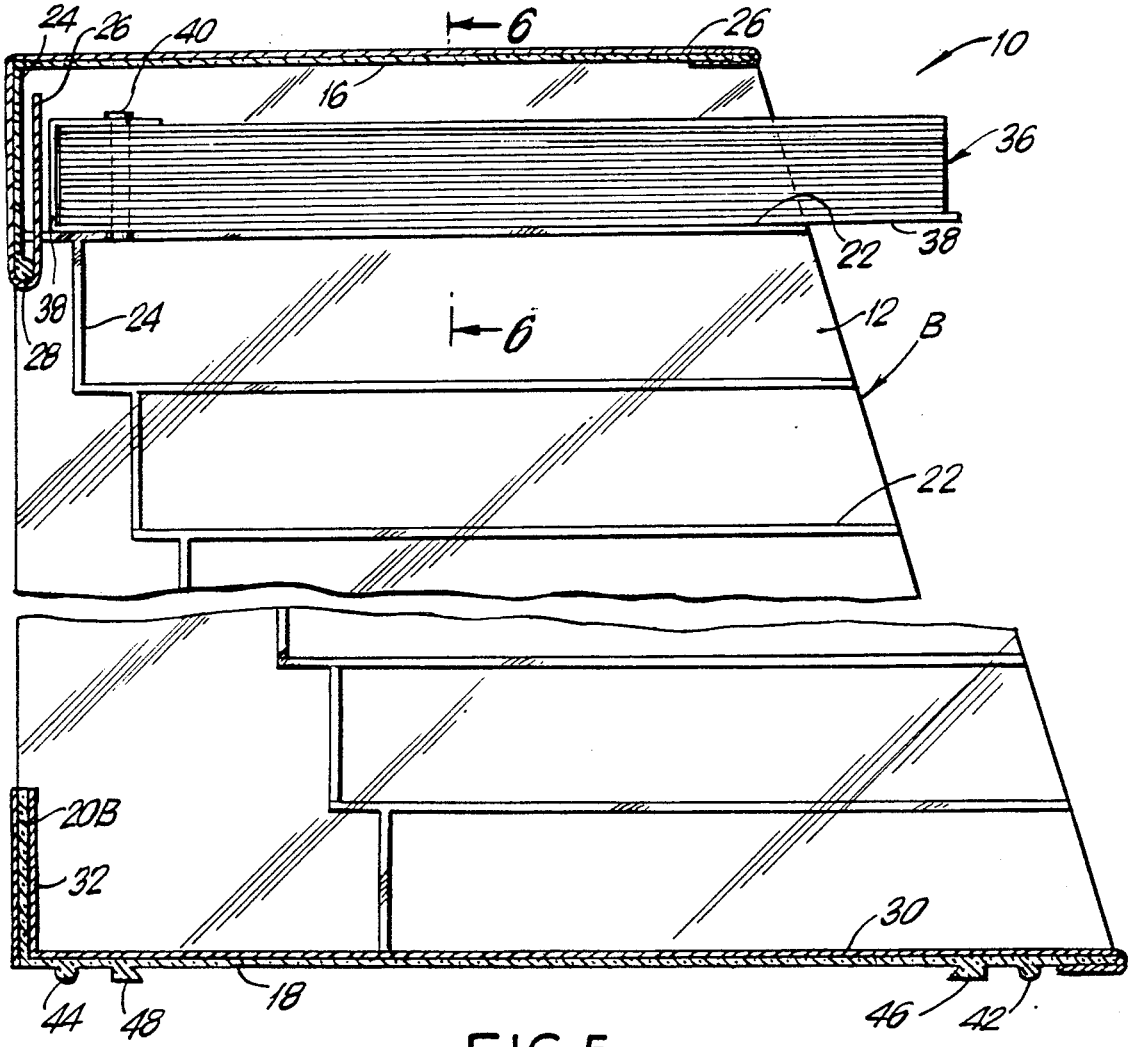
FIG. 5 is a sectional view along line 5—5 of FIG. 3.
Figure 6:
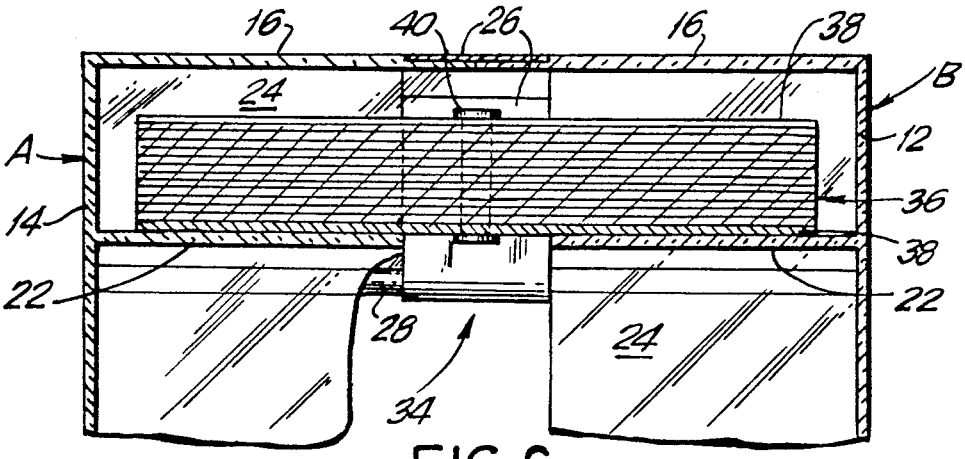
FIG. 6 is a sectional view along line 6—6 of FIG. 5 showing the manner of joinder of the two halves which make up the container.
Figure 7:
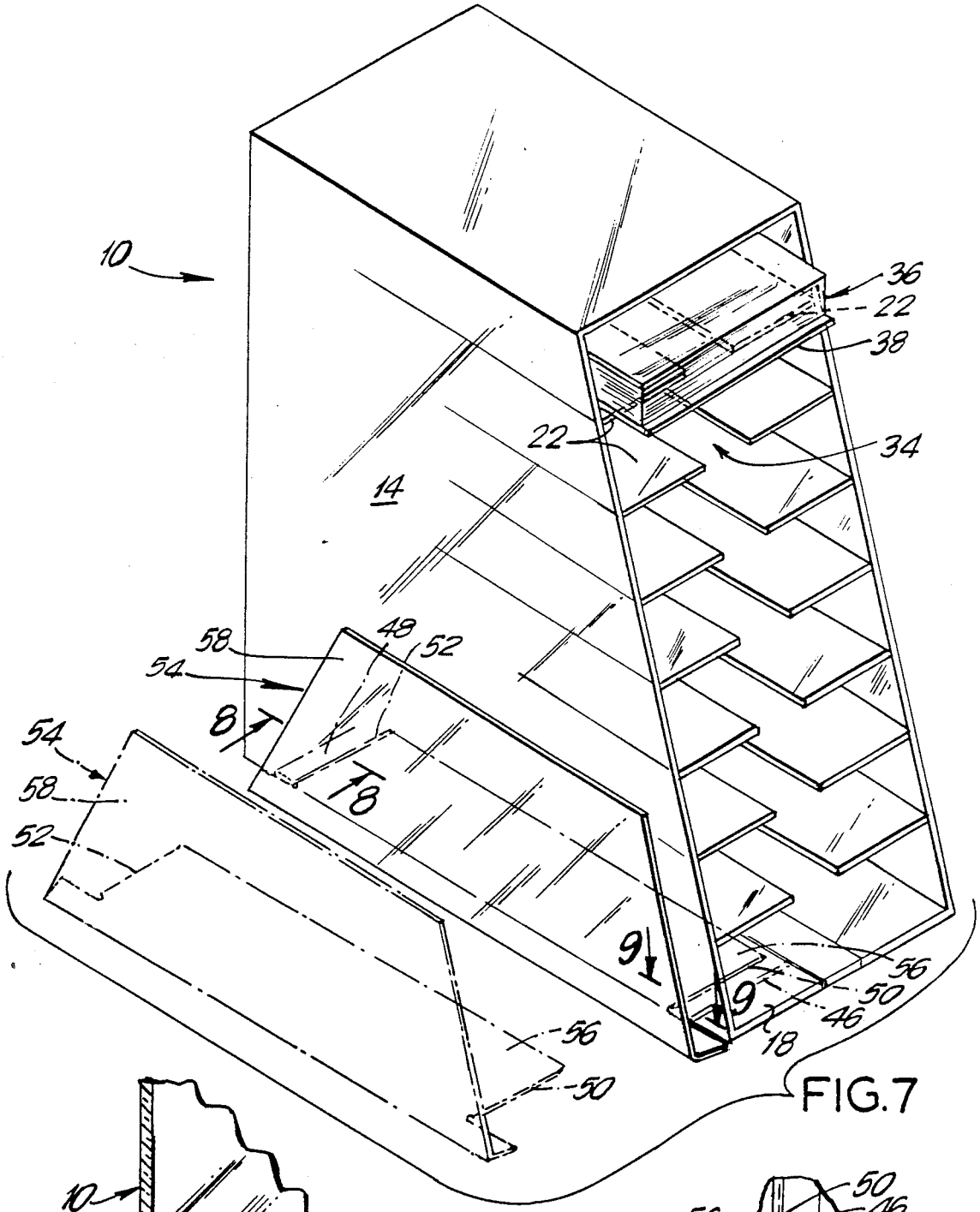
FIG. 7 is a schematic perspective view similar to FIG. 1 showing how a removable element is connected with the container.
Figure 8:
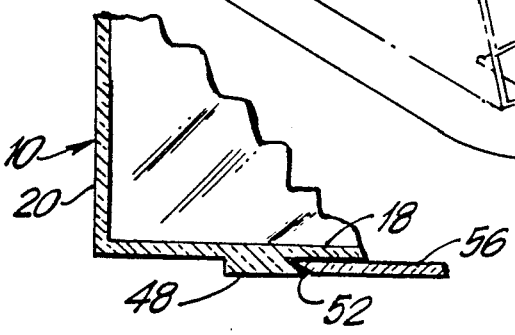
FIG. 8 is a vertical sectional view along line 8—8 of FIG. 7 lacking in the direction of the arrows.
Figure 9:
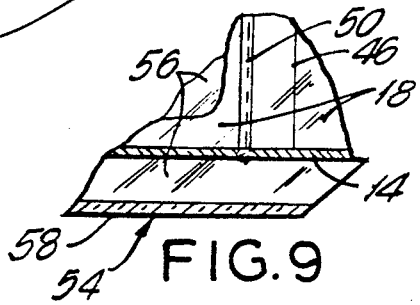
FIG. 9, is a horizontal sectional view along line 9—9 of FIG. 7 looking down in the direction of the arrows.

As shown in FIG. 5, the bottom 18 of container 10 can be provided with means 42, 44 for lifting its bottom somewhat. As seen in FIGS. 7 to 9, especially FIG. 8, there are provided tracks 46, 48 which cooperate with guides 50, 52 (FIG. 7) of a right angled element 54 comprising a base 56 and a wall 58. By engaging guides 50, 52 with tracks 46, 48, element 54 can be joined with and spaced from the side of container 10 to define a storage space, as for literature relating to the wall covering samples.

In use: a book 36 made up of stacked wall covering samples, has a spine 38 which in conventional manner extends around to the front and back and a fastener 40 holds the samples in the book. In assembled functioning state, a book 36 rests on each shelf 22 with its fastener 40 seating in the space of track 34. In insertion and removal the cooperation between the fastener 40 and track 34 controls proper operation.

Advantageously, each half of the structure is integrally molded of plastic, e.g. clear acrylate, polystyrene, or somewhat more flexible polyoletin.

As shown, the shelves are advantageously staggered as in a stair case, preferably at an angle of 60 to 80 degrees, but they could be vertically arranged. The structure could even omit the space in mid-shelf.

Eight shelves are shown but more or less could be provided.

The device could be integral rather than formed of joined halves.

It is understood that the specification and examples are illustrative but not limitative of the present invention and that other embodiments within the spirit and scope of the invention will suggest themselves to those skilled in the art.

We claim:

1. A multi-shelf storage container comprising a top, bottom rear, and a pair of side walls spaced from one another, the front of said container between said side walls being open, the side walls being canted rearwardly from bottom to top, and a plurality of essentially horizontal shelves extending between said side walls and from said open front toward said rear, the top, bottom, rear and each shelf being comprised of two halves, the halves of each shelf being laterally spaced from one another to define a path therebetween, each set of shelf halves on one side of such path being connected with one of the side walls, the container including means for joining the one another the halves of at least one of the top, bottom or rear.

2. A container according to claim 1, wherein the joining means join the halves of each of the top, bottom and rear.

3. A container according to claim 1, wherein each vertical set of shelf halves is integrally molded with its associated side and half top and bottom.

4. A container according to claim 1, wherein the rearward cant is at an angle of about 60 to 80 degrees.

5. A multi-shelf storage container comprising a top, bottom, rear, and a pair of side walls spaced from one another, the front of said container between said side walls being open and a plurality of essentially horizontal shelves extending between said side walls and from said open front toward said rear, the top, bottom, rear and each shelf being comprised of two halves, the halves of each shelf being laterally spaced from one another to define a path therebetween, each set of shelf halves on one side of said path being connected with one of the side walls, the container including means for joining to one another the halves of at least one of the top, bottom or rear.

6. A container according to claim 5, wherein the joining means join the halves of each of the top, bottom and rear.

7. A container according to claim 5, wherein each vertical set of shelf halves is integrally molded with its associated side and half top and bottom.

8. In combination, a container according to claim 5 and a plurality of samples each disposed on one of the shelves, each sample including a member which seats in the space between a pair of the shelf halves.

9. In combination, a container according to claim 1 provided with one half of a joinder, and an element comprising a wall, a base and the other half of the joinder, said element and container being joined to define a storage space alongside the container.

10. A container according to claim 1, wherein each shelf is of approximately the same length.

* * * * *

UNITED STATES PATENT AND TRADEMARK OFFICE

CERTIFICATE OF CORRECTION

PATENT NO. : 5,109,991

DATED : May 5, 1992

INVENTOR(S) : McPherson, et al.

It is certified that error appears in the above-identified patent and that said Letters Patent is hereby corrected as shown below:

Col. 3, line 25 Delete " the " (first occurence) and substitute -- to --

Signed and Sealed this

Twelfth Day of April, 1994

Bruce Lehman

*Attest:*

BRUCE LEHMAN

*Commissioner of Patents and Trademarks*

*Attesting Officer*